United States Patent [19]

Wright

[11] 4,275,533

[45] Jun. 30, 1981

[54] PORTABLE BUILDING AND METHOD OF TRANSPORTING IT

[76] Inventor: Darold L. Wright, 1151 Calhoun St., Hayward, Calif. 94544

[21] Appl. No.: 68,705

[22] Filed: Aug. 22, 1979

[51] Int. Cl.[3] ..... E04H 1/00; E04H 1/12

[52] U.S. Cl. ..... 52/79.1; 52/143; 52/236.3

[58] Field of Search ..... 52/79.1, 79.2, 79.3, 52/79.5, 122, 143, 234, 236.3

[56] References Cited

U.S. PATENT DOCUMENTS

| | | | |
|---|---|---|---|
| 1,219,786 | 3/1917 | Splater | 52/143 X |
| 2,296,413 | 9/1942 | Zell | 52/143 X |
| 2,493,099 | 1/1950 | Adams | 52/122 X |
| 2,701,038 | 2/1955 | Mooney | 52/143 X |
| 2,731,680 | 1/1956 | Bolt | 52/143 X |
| 3,095,616 | 7/1963 | Bigelow | 52/143 X |
| 3,289,382 | 12/1966 | Van Der Lely | 52/122 X |
| 3,609,929 | 10/1971 | Brown et al. | 52/79.3 X |
| 3,861,093 | 1/1975 | Robinson | 52/236.3 X |
| 3,913,286 | 10/1975 | Boutacoff | 52/79.1 X |

FOREIGN PATENT DOCUMENTS

| | | | |
|---|---|---|---|
| 1160163 | 12/1963 | Fed. Rep. of Germany | 52/143 |
| 1562963 | 3/1969 | France | 52/143 |
| 779485 | 7/1957 | United Kingdom | 52/79.1 |

*Primary Examiner*—J. Karl Bell

*Attorney, Agent, or Firm*—Robert Charles Hill

[57] ABSTRACT

A portable building of the type having a floor, side walls and a roof structurally interconnected to form an integral building unit, the building also including skid means for engaging the ground and supporting the building in a free-standing condition, reinforced slide means being formed beneath the building floor for engaging and supporting structural chassis members of a transport vehicle while withstanding stress of sliding the building onto and off of the vehicle during loading and unloading, and means structurally interconnected with the building for sliding it onto and off of the vehicle, the building preferably being of modular construction and including self-contained service means such as air conditioning, electrical service and the like.

11 Claims, 8 Drawing Figures

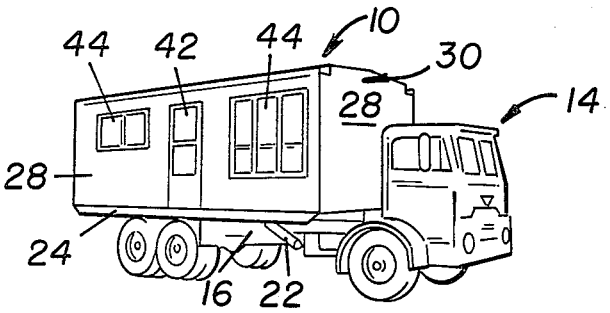
FIGURE 3
FIGURE 2
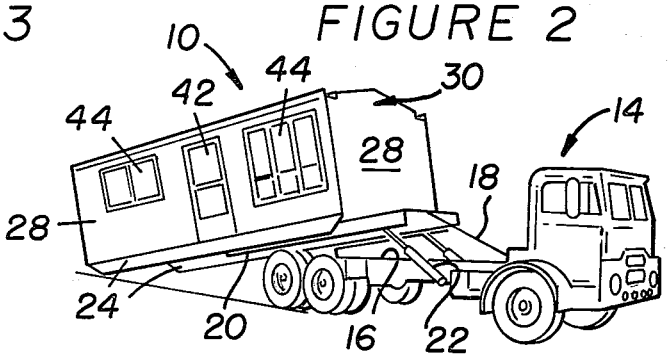
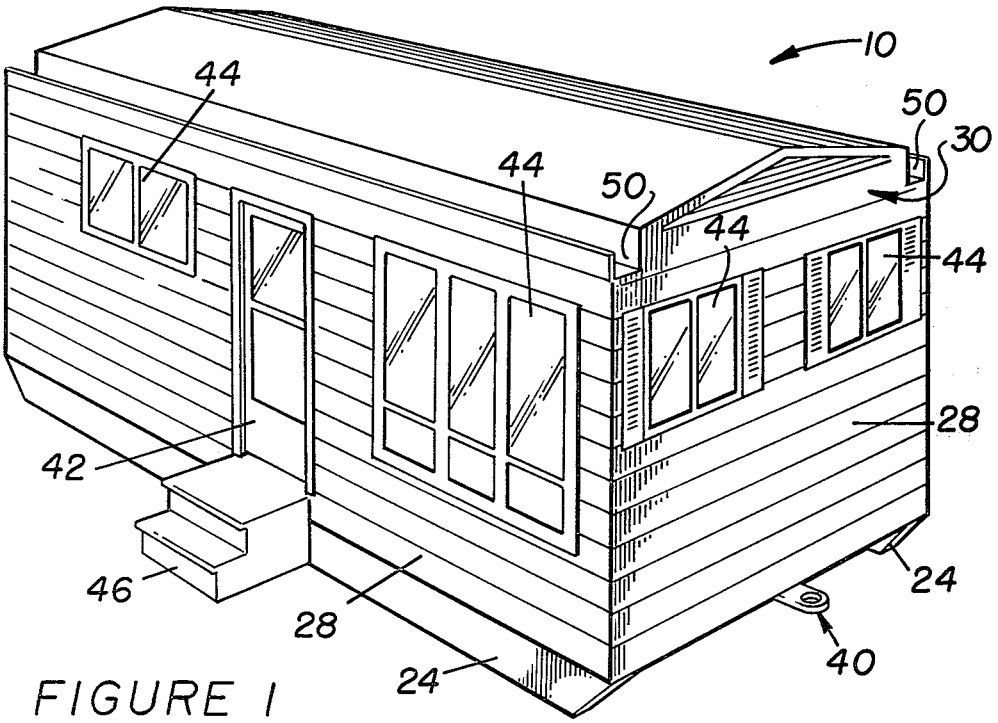
FIGURE 1

PORTABLE BUILDING AND METHOD OF TRANSPORTING IT

BACKGROUND OF THE INVENTION

The present invention relates to portable buildings and more particularly to such buildings which are of rigid reinforced construction and include means adapting them for being slid onto and off of a transport vehicle in a condition ready for immediate use.

A number of different portable buildings have been provided in the prior art. However, most of these buildings are either of a type adapted for self-trailering operation wherein running gear is either an integral portion of the building or the building is adapted to receive running gear including axles and wheels for example during transport operations. One example of a portable building of this type is illustrated in U.S. Pat. No. 2,805,884 issued Sept. 10, 1957.

Yet another type portable building provided in the prior art contemplates a collapsible building where the side walls and roof for the building may be folded or arranged in a compact configuration upon the building floor during transport operations. Here again, it is noted that the self-trailering building contemplated by the reference noted immediately above also includes a roof adapted to be collapsed in order to reduce the overall height of the building during transport operations. Other examples of portable buildings in the prior art also contemplate formation of side walls for the building which may be similarly collapsed in order to arrange the side walls and roof upon the floor of the building. A portable building of this type is illustrated, for example, in U.S. Pat. No. 3,023,463 issued Mar. 6, 1962.

Portable buildings of the type referred to above have proven effective in that they may be moved from location to location as required. However, the design and manner of transportation and assembly often become relatively complex for such buildings. For example, self-trailering portable buildings have long been available in the form of trailer homes and the like. However, these units include relatively complex running gear which substantially increases their cost. If the running gear is removable from the portable building, the method of transport becomes more complicated because of the need for assembling the running gear upon the building and removing it after the building has been transported to a new location.

As for buildings including collapsible roof members and/or side walls, it is obvious that substantial time is required for erection and dismantling of the building either upon arrival at a new site or prior to transport of the building from a given site.

Finally, many portable buildings of the type referred to above have excessively large dimensions requiring special permits in order to move them upon public streets or roads. The obtaining of such permits and the need for moving the buildings during militant time periods further complicates the method of transport.

Accordingly, there has been found to remain a need for a portable building which is of simple construction and is further adapted for transport in a simple manner while being ready for immediate use after transport.

SUMMARY OF THE INVENTION

Accordingly, it is an object of the present invention to provide a portable building of the type referred to above.

More specifically, it is an object of the present invention to provide a portable building having fixedly interconnected floor, side walls and roof so that the building is always ready for immediate use, the building further including integral reinforced means to withstand the stress of sliding the building onto and off of supporting structural chassis members of a transport vehicle in order to rapidly and simply transport the building to a new location.

It is a related object of the invention to provide a method for transporting such a building by means of a vehicle having exposed structural chassis members, sliding the building onto the chassis members, moving the building to a new location by means of the transport vehicle, sliding the building off of the vehicle and onto the ground in a condition for immediate use.

In order to adapt a portable building for use in accordance with the two preceding objects, it preferably includes skid means mounted beneath the floor for engaging the ground and supporting the building in a freestanding condition, reinforced slide means also being formed beneath the floor of the building for engaging the supporting chassis members of the vehicle while withstanding stress of sliding the building onto and off of the vehicle during loading and unloading and providing means structurally interconnected with the building for sliding it onto and off of the vehicle. Preferably, the skid means and slide means are separately formed beneath the building for respectively supporting the building in a freestanding condition and for engaging the supporting chassis members of the vehicle. However, it would also be possible to form the reinforced slide means as a portion of skids so that the base surface of the skids would be adapted both to engage the ground and support the building in a freestandiing condition and also to engage the supporting chassis members of the vehicle. However, the skid means and slide means are preferably formed separately beneath the building in order to reduce the overall height of the building when it is arranged in a transport condition upon the vehicle. The means for sliding the building onto and off of the vehicle may comprise, for example, a hook arranged at one or both ends of the vehicle to be engaged by a wench and cable arrangement.

It is also an object of the invention to provide such a portable building which is of modular construction so that a single building may be used by itself or two or more buildings may be interconnected in order to provide a larger interior space.

Yet another object of the invention is to provide such a portable building having a fixed reinforced frame while including self-contained service means such as air conditioning, electrical service and the like in order to better adapt the building for intermediate use upon being unloaded from the transport vehicle.

Additional objects and advantages of the invention are made apparent in the following description having reference to the accompanying drawings.

BRIEF DESCRIPTION OF THE DRAWINGS

FIG. 1 is a perspective view of a portable building constructed in accordance with the present invention.

FIG. 2 is a view illustrating the manner in which a portable building such as that illustrated in FIG. 1 is loaded onto or unloaded off of a suitable transport vehicle.

FIG. 3 is a view of the portable building raised in a transport condition upon the vehicle.

DESCRIPTION OF THE PREFERRED EMBODIMENT

Figure 4:
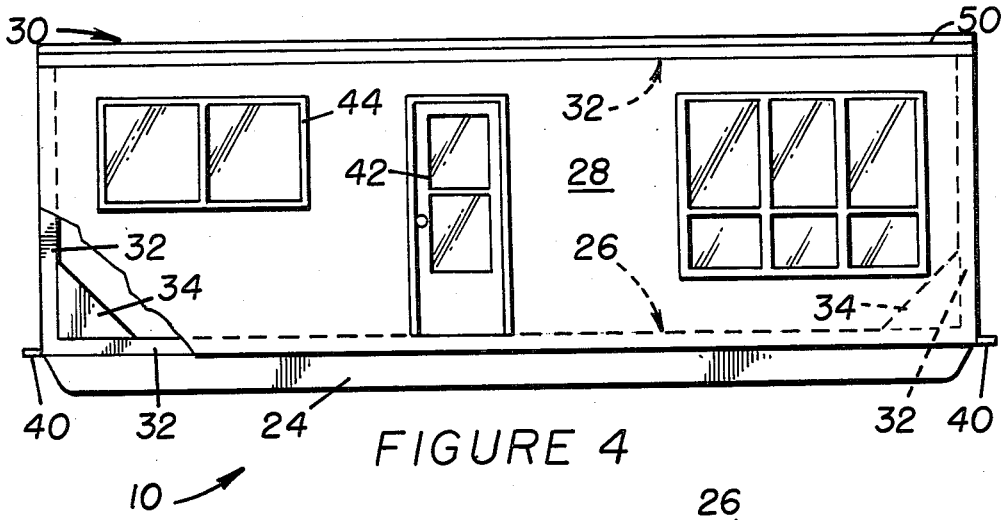
FIG. 4 is a side view of the portable building of FIG. 1 with parts illustrated in phantom and part of the portable building being broken away to better illustrate its integral, reinforced construction.

A portable building of the type contemplated by the present invention is indicated at 10 in FIG. 1, for example, and conditioned for immediate use or occupancy. As will be described in greater detail below, the building is preferably of rigid, reinforced construction so that it is ready for immediate use upon delivery to a selected site, the building also preferably being of modular construction as may be best seen, for example, in FIG. 8 which illustrates a modular assembly 12 formed from a plurality of buildings such as that indicated at 10 in FIG. 1.

According to the present invention, the portable building 10 is of a particularly simple and durable construction permitting it to be transported by a vehicle of the type illustrated in FIGS. 2 and 3 while being ready for immediate use or occupancy upon delivery. The vehicle indicated at 14 in FIGS. 2 and 3 is of a general type commonly employed for sanitation purposes in the delivery and retrieval of large drop boxes (not shown). For this reason, structural support members in a rearward chassis portion of the vehicle are exposed and provide elongated support surfaces upon which a load may be carried. The vehicle 14 preferably includes a pair of such structural support members arranged in parallel, one of the members being indicated at 16 in FIGS. 2 and 3. The vehicle is also equipped with a winch and cable assembly 18 to assist in sliding a load into place upon the chassis support member 16. As may be best seen in FIG. 2, the vehicle 14 is preferably of a type including additional support members 20 which are controlled by hydraulic cylinders 22 and may be positioned either in abutting engagement upon the support members 16, as illustrated in FIG. 3, or may be shifted rearwardly and tilted, as illustrated in FIG. 2, to further assist in loading or unloading operations.

In order to adapt the portable building 10 for use in conjunction with such a vehicle, the building includes elongated skids 24 arranged along the lateral edges of the building in order to support the building in a free-standing condition upon the ground. The wide spacing of the skids 24 naturally provides maximum stability for the building. As will be described in greater detail below having reference particularly to FIG. 5, the floor of the building includes reinforced slide means for engaging either the movable support members 20 of the vehicle 14 in order to resist stress applied to the building during loading and unloading operations.

Figure 8:
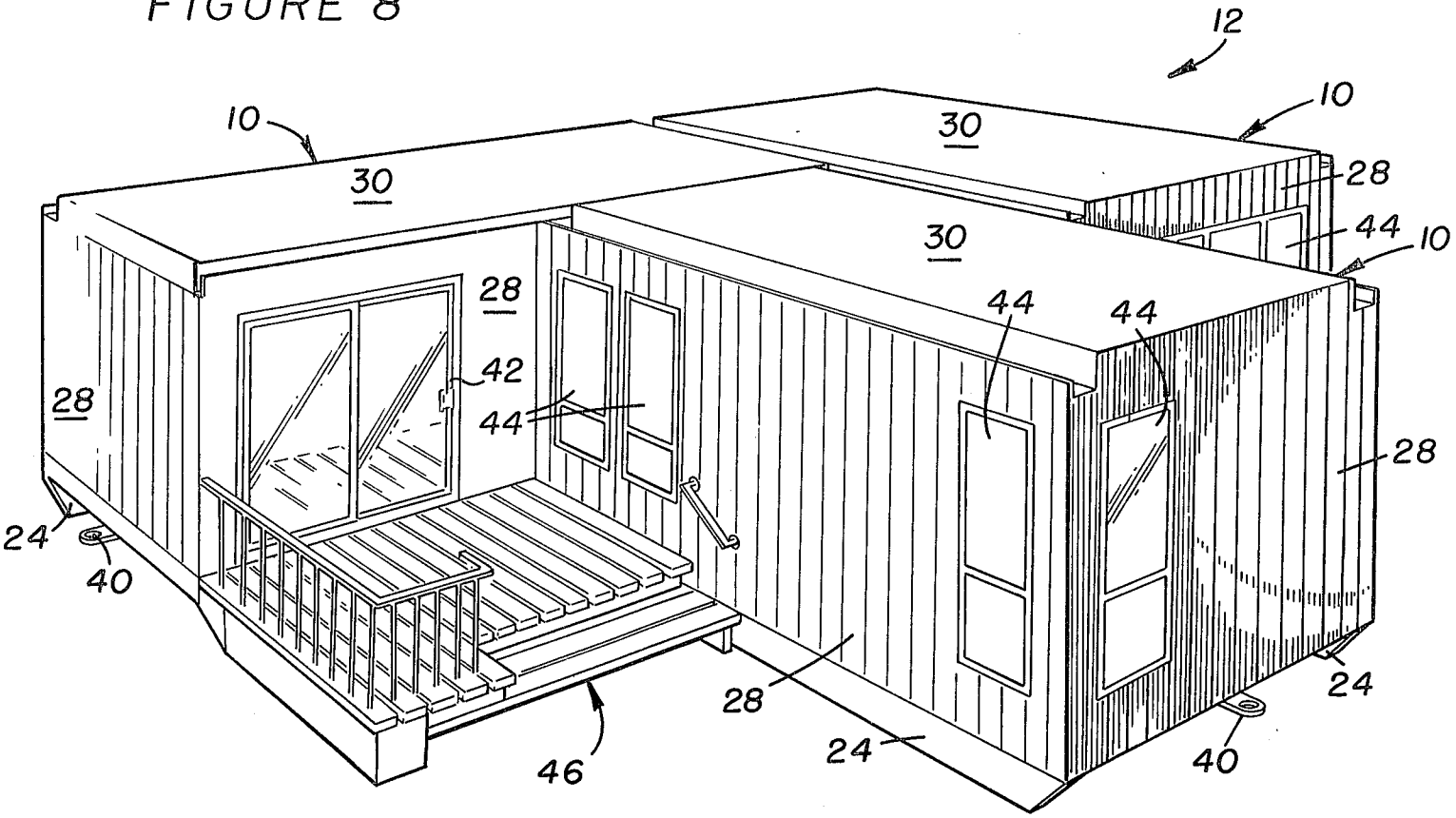
FIG. 8 is a view of three of the portable buildings combined together to better illustrate their modular construction.

It will be immediately apparent that a building constructed in the manner summarized above is of particularly simple construction while facilitating rapid transportation upon a vehicle such as that indicated at 14. In addition, the building is of rigid reinforced construction so that it is ready for immediate use or occupancy upon delivery to a selected site. As will also be described in greater detail below, the building is preferably of modular construction so that each portable building 10 may be used alone or combined in an assembly as illustrated in FIG. 8. The modular construction of each portable building 10 also permits the dimensions of the building to be selected for complying with load requirements for major highways and the like in order to further facilitate transport operations. At the same time, the rigid construction of the building permits service components such as air conditioning, electrical service or the like to be installed in place within the building ready for use upon delivery. Additional advantages of the portable building will be apparent from the more detailed description set forth below.

Figure 5:
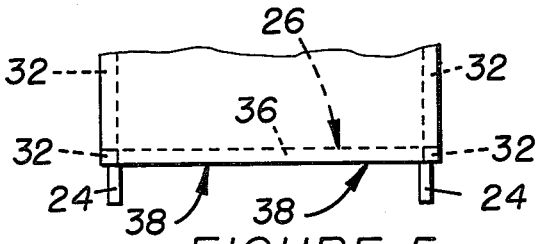
FIG. 5 is a fragmentary end view of the floor portion of the building to illustrate the manner in which the building is supported upon the ground and upon a transport vehicle.
Figure 6:
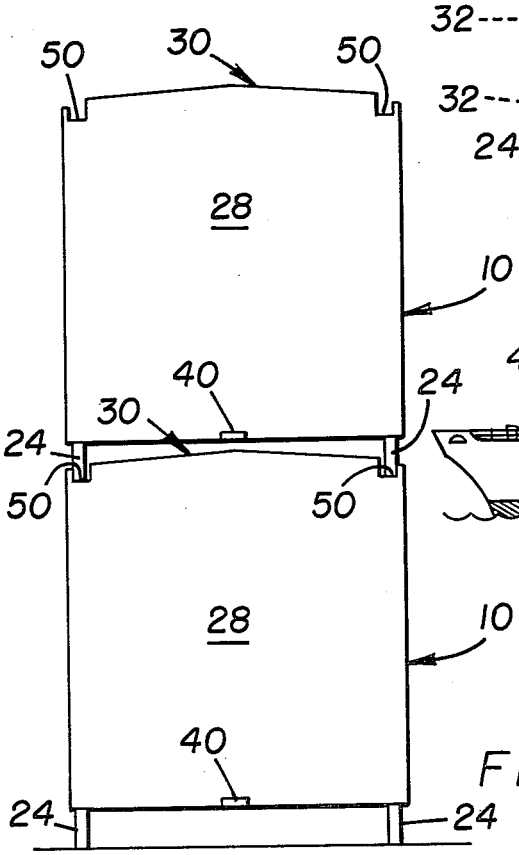
FIG. 6 is a view of a preferred adaptation of the portable building adapting two or more of the portable buildings to be stacked one on top of the other.

Referring to FIGS. 4 and 5 as well as FIG. 1, the building is formed with a floor 26, side walls 28 and a roof 30 which are rigidly and fixedly interconnected to form the building 10. Reinforcement for the building 10 is provided by rectangular tubular members 32 which form a framework for the building and are interconnected by means of gusset plates 34 to provide an even stronger structure for the building. As may be seen in FIG. 5, additional structural members 36 extend crosswise between the rectangular tubular members 32 in the floor 26 in order to provide reinforcement for slide surfaces 38 which are adapted to engage the support members 20 upon the vehicle 14 of FIGS. 2 and 3. As was also noted above, the reinforced slide surfaces 38 could also be formed upon the skids 24. For example, the skids 24 might be moved inwardly for alignment with the chassis support members 20. However, such an arrangement would tend to increase the overall height of the building when arranged and placed upon the vehicle 14 for transport. Accordingly, the skids 24 are preferably arranged at the lateral edges of the building in order to decrease the overall height of the building when positioned upon the vehicle and also to provide greater stability in a freestanding condition upon the ground as was also noted above.

In order to load and unload the portable building 10 from the vehicle 14, additional means such as the hook indicated at 40 is also structurally interconnected with the building at each end thereof. Accordingly, in order to load the building upon the vehicle, the wench and cable assembly 18 may be connected directly to the hook 40 in order to slide it into place upon the support members 20. It will also be apparent that the building could be slid directly onto the chassis support member 16 of the vehicle without need for the pivotable support members 20 or the hydraulic cylinders 22. However, the assembly particularly facilitates loading and unloading of the portable building from the vehicle. In order to unload the building, the cylinders 22 may be extended in order to pivot the support members 20 upwardly and rearwardly in order to permit the building 10 to slide off of the truck under the influence of gravity. On the other hand, in some applications, it may be desirable in order to provide another hook similar to that indicated at 40 at the opposite end of the building in order to assist in unloading of the building.

The building 10 as illustrated in FIG. 1 is preferably adapted for use as an office or temporary residence and is provided with a door 42 and windows 44. The building 10 may also include a removable panel (not shown) in order to better adapt it for modular assembly as illustrated in FIG. 8. The building 10 of FIG. 1 is also provided with a portable stoop 46 which may be placed in front of the door 42 after the building is in place. As was noted above, air conditioning, electrical service and the like (not otherwise shown) preferably form an integral portion of the portable building 10 and may be arranged for example within the fixed roof 30 so that the building is ready for immediate use upon delivery.

It is also contemplated that the portable building 10 may be used for other applications in addition to providing an office or temporary residency. For example, the building may have side walls formed without windows in order to provide storage. In addition, the building may be equipped as a portable field laboratory and may similarly be ready for immediate use upon delivery.

Figure 7:
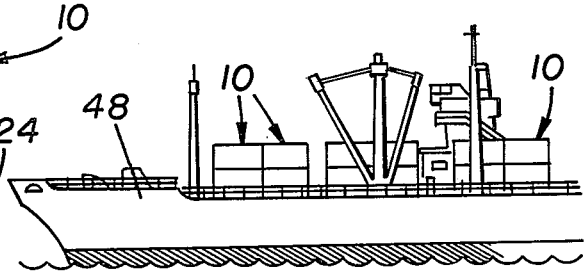
FIG. 7 is a view of a containership illustrating one example for transport of stacked portable buildings of the type illustrated in FIG. 6.

It is further contemplated that the modular portable building unit 10 may desirably be adapted for stacking one on top of the other in certain applications. For example, it is contemplated that such buildings may be adapted for transport upon containerships of the type indicated at 48 in FIG. 7. The rigid reinforced construction of the building particularly adapts it for such an application. In addition, with the skids 24 being arranged adjacent the lateral edges of the building 10, the roof 30 of each building may be formed with structural support gutters 50 also arranged adjacent its lateral edges in order to receive the skids 24 of a building stacked thereupon. This permits the buildings to be stacked in a nested configuration which also tends to prevent undesirable shifting of the portable buildings stacked one on top of the other.

The manner of transport for the portable building 10 is believed apparent from the preceding description. However, the method of transport is also described below in order to insure a better understanding of the invention. When it is necessary or desirable to move a portable building such as that indicated at 10 in FIG. 1, the building is first conditioned for transport by storing the portable stoop 46 for example within the building. Otherwise, the building is ready for immediate transportation except for unhooking of whatever service facilities are provided to the building. Thereafter, a vehicle such as that indicated at 14 is arranged adjacent the building and the winch and cable assembly 18 is connected with the hook 40. The building is then loaded onto the truck by the operation illustrated in FIG. 2 so that it is in a transport position illustrated in FIG. 3. In that condition, the building may be rapidly transported by the vehicle 14 to a selected site and unloaded in a generally similar manner. Thereafter, the building is generally ready for immediate use except for the reconnection of necessary service means.

Additional modifications and variations are believed obvious from the preceding description. Accordingly, the scope of the present invention is defined only by the following appended claims.

I claim:

1. In a portable building of the type having a floor, side walls and a roof fixedly interconnected with each other, the combination comprising skid means mounted on the floor of the building and arranged generally adjacent the lateral edges thereof for engaging the ground and supporting the building in a freestanding condition, reinforced slide means formed beneath the floor of the building inwardly of said skid means for engaging supporting structural chassis members of a transport vehicle and withstanding stress of sliding the building onto and off of the vehicle during loading and unloading, and means structurally interconnected with the building for sliding it onto and off of the vehicle.

2. The portable building of claim 1 being of modular construction for use individually or in combination with one or more additional portable buildings.

3. The portable building of claim 1 wherein the means for sliding the building onto and off of the vehicle comprises at least one hook structurally interconnected with the building floor.

4. The portable building of claim 3 wherein an additional hook is structurally interconnected with the building floor at the other end thereof.

5. The portable building of claim 1 further comprising self-contained service means arranged within an integral portion of the building in order to adapt the building for immediate use upon delivery to a selected site.

6. The portable building of claim 1 further comprising a structural framework for supporting the fixedly interconnected floor, side walls and roof.

7. The portable building of claim 6 wherein the structural framework is formed from tubular members for increased structure strength while reducing the overall transport weight of the building.

8. The portable building of claim 1 wherein the roof of the building forms similarly spaced apart structural gutters to permit stacking and unstacking of the portable buildings one on top of the other.

9. In a method for transporting a portable building for temporary use at different selected sites, the combination comprising forming the building with a floor, side walls and a roof fixedly interconnected with each other, mounting skid means on the floor of the building and arranged generally adjacent the lateral edges thereof for engaging the ground and supporting the building in a freestanding condition, providing reinforced slide means in the floor of the building inwardly of the skid means for engaging supporting structural chassis members of a transport vehicle, providing a transport vehicle having exposed structural chassis support members and winch means for loading and unloading, attaching the winch means to a structural portion of the portable building and sliding it onto the structural support members of the vehicle, transporting the building to a selected site by means of the vehicle, sliding the building off of the structural support members and into its skid means in a freestanding condition substantially ready for immediate use.

10. The method of claim 9 further comprising the step of providing self-contained service means within a fixed portion of the building in order to further adapt it for immediate use upon delivery to the selected site.

11. The method of claim 9 further comprising the step of transporting a plurality of similar portable buildings of modular construction in order to adapt their combination into a composite building assembly.

* * * * *